US007309303B1

(12) United States Patent
Proctor

(10) Patent No.: US 7,309,303 B1
(45) Date of Patent: Dec. 18, 2007

(54) EXERCISING AND PHYSIOTHERAPY SYSTEM

(76) Inventor: Richard Proctor, 2400 Las Gallinas Ave., Suite 115, San Rafael, CA (US) 94903

( * ) Notice: Subject to any disclaimer, the term of this patent is extended or adjusted under 35 U.S.C. 154(b) by 540 days.

(21) Appl. No.: 10/757,272

(22) Filed: Jan. 14, 2004

(51) Int. Cl.
*A63B 21/04* (2006.01)
*A63B 21/045* (2006.01)

(52) U.S. Cl. ..... 482/121; 482/42; 482/74; 482/96; 482/123; 482/127; 482/129; 482/130; 482/141; 482/907

(58) Field of Classification Search ..... 482/36, 482/38, 41, 42, 74, 78, 91, 92, 95, 96, 121, 482/122, 123, 125–127, 129, 130, 138, 139, 482/141–143, 148, 907
See application file for complete search history.

(56) References Cited

U.S. PATENT DOCUMENTS

| | | | | | |
|---|---|---|---|---|---|
| 2,852,218 | A * | 9/1958 | Stires | 248/513 |
| 3,472,509 | A * | 10/1969 | Flynn | 482/36 |
| 3,701,529 | A * | 10/1972 | Kruthaupt et al. | 482/123 |
| 3,814,416 | A * | 6/1974 | Munger et al. | 482/36 |
| 4,212,461 | A * | 7/1980 | Cecka et al. | 473/535 |
| 4,241,914 | A * | 12/1980 | Bushnell | 482/130 |
| D278,490 | S * | 4/1985 | Stevens | D6/462 |
| 5,078,388 | A * | 1/1992 | Dempsey, Jr. | 482/49 |
| 5,209,712 | A * | 5/1993 | Ferri | 482/91 |
| 5,326,337 | A * | 7/1994 | Pardella | 482/36 |
| 5,395,296 | A * | 3/1995 | Webster et al. | 482/130 |
| 5,529,550 | A * | 6/1996 | Maycock et al. | 482/44 |
| 6,036,621 | A * | 3/2000 | Hancock | 482/47 |
| 6,152,587 | A * | 11/2000 | Berg | 362/494 |
| 6,641,510 | B2 * | 11/2003 | Koenig | 482/104 |
| 7,041,033 | B2 * | 5/2006 | Tom | 482/10 |
| 7,153,248 | B2 * | 12/2006 | Chen | 482/121 |
| 7,229,393 | B2 * | 6/2007 | Liang et al. | 482/130 |
| 2003/0232707 | A1 * | 12/2003 | Dalebout et al. | 482/123 |
| 2004/0147380 | A1 * | 7/2004 | Mattox | 482/139 |
| 2007/0093366 | A1 * | 4/2007 | Zuckerman | 482/121 |

OTHER PUBLICATIONS

Bowflex—Your Home Fitness Solution.

* cited by examiner

*Primary Examiner*—Kevin C. Sirmons
*Assistant Examiner*—Victor K. Hwang
(74) *Attorney, Agent, or Firm*—Thomas M. Freiburger

(57) ABSTRACT

An exercising system has a frame defining a space in which a user is positioned for performing a large number of different exercises. Frame members have holes within which flexible bars are positioned, spanning across the machine, for low-impact exercising using the bars. In a preferred embodiment the bar-supporting frame members, or some of them, are adjustable in position so as to provide a nearly unlimited number of positions for different users and for different exercises. A few of the many exercises facilitated by the system are described.

30 Claims, 15 Drawing Sheets

EXERCISING AND PHYSIOTHERAPY SYSTEM

BACKGROUND OF THE INVENTION

The invention concerns exercising equipment, and specifically a system utilizing flexible bars to facilitate a nearly unlimited number of different exercises for users of different sizes and strengths.

Exercising equipment has been available in many different forms. From free weight lifting to various types of machines that a user sits on or stands on and which operate with weights, cables and pulleys or with compressed air, hydraulic or electrical resistance or other types of resistance, these exercising systems and devices have usually been provided in health clubs and gyms. Other machines have been devised primarily for the home market, for individual users. One example is sold as the Bowflex exercising machine, a freestanding apparatus that includes cantilevered bars that are tapered, so as to bend more at their ends, for performing several exercises. The exercises available, and the variation in performing them, are very limited.

Most exercise machines are single purpose exercise machines. Movement is restricted to the fixed mechanical motion of the machine that provides resistance in a certain direction with either a handle or lever. The resistance is usually a steel weight connected through a cable to a handle, very rigid with very little give, not springy. Most prior equipment restricts people to very unnatural body posture while exercising. Either one is lying on his back or leaning the chest against something, or with restrictive motion against the back. Other machines are very limited compared to the present system, restrictive in access, i.e. getting on and off the machine.

There is a need for a more comprehensive, effective and easily used exercising and physiotherapy system for non-impact exercising of numerous muscles and joints of the body to achieve improvements in a patient's strength and range of motion, balance and coordination for users of widely varying sizes, strengths (from the strongest in the world to the weakest), physical abilities and ranges of joint motion. Such a system should provide for both horizontal and vertical exercises, involving the muscles of the arms, legs, neck, back, stomach and other parts of the body.

SUMMARY OF THE INVENTION

An exercising and physiotherapy system of the invention has a frame defining a space in which a user can perform a large number of different exercises. The system includes a collection of flexible bars, sufficiently flexible to bend when engaged in exercising movements by a user, including bars in a range of different stiffnesses. On the frame are bar supports for receiving and suspending the bars from their ends. When used in exercises the bars flex and pull inwardly along the frame supports, this sliding movement being permitted by the frame supports. The bar supports are in a plurality of locations on the frame, allowing the positioning of one or more bars in a multiplicity of different locations for a large number of different exercises for different exercising users.

In a preferred embodiment the bar supports comprise vertically oriented frame members having series of holes within which the flexible bar can be positioned, spanning across the frame. Enlarged heads on the bars preferably are provided to prevent the bar from pulling out of the frame during exercising, when the bar is deflected and its end is at an oblique angle. The frame members may be in many different locations, to support different exercises and different users. In one specific embodiment the vertically oriented frame members are supported between horizontal frame members and are moveable along those horizontal members to any selected position. Thus, these vertical frame members can be slidably adjusted at both sides of the exercising system to left and right corresponding positions for placement of one or more bars. An appropriate locking device is included, to hold the vertical bar support frame members in the selected positions. The slidably positioned bar support members may be at three different levels, supported at three different spacings between adjacent horizontal frame members. In this way a nearly unlimited number of positions are possible for different users and different exercises.

In one preferred embodiment the exercising machine of the invention has horizontal frame members with bar supports for vertically-oriented exercising bars. A plurality of horizontal frame members in a preferred embodiment have series of holes, these horizontal members being either fixed or moveable within the frame. The bars for this purpose have an integrally molded, enlarged disc on the bar, at least at one end, large enough to prevent the bar from sliding down through a hole when used vertically.

The flexible bars in preferred embodiments are of a plastic material, which may be acetal, a strong material which can be provided in a series of different diameters for different flexibilities and resistances. Virtually no abrasion of the surface of the bar occurs during exercising, because of the material and because the holes in the bar supports on the frame have rounded or beveled edges to prevent such abrasion.

The system also preferably includes at least one foot platform for supporting the weight of the user. This may include a fixed, angled foot platform, a bar-supported and thus flexibly positioned foot platform, or both. The angled foot platform is secured to the frame at or near an end of the frame to facilitate certain exercises in which the user's body is in an angled or inclined position, or even nearly horizontal. For example, pushups or rowing movements can be done with the feet on this angled platform and the body in an angled or horizontal position (but normally with some incline), and the hands on one or two of the flexible bars supported in the frame. The flexibly suspended foot platform is supported and connects to a pair of parallel flexible bars that are supported by the frame, providing a vertical standing base for other exercises, such as pulling up with the arms gripping a flexible bar with the feet on the platform. This flexibly supported foot platform can be used for exercises in which the user stands on the platform and runs in place or performs pullups or other lifting exercises with extremely low impact.

The collection of bars may include approximately 10 or 12 different bars. Preferably some of the bars, or at least one of the bars, is sufficiently stiff as to support the full weight of a user with the bar supported on the frame. As an example, the collection of bars may have a range of stiffness permitting from about 400 lbs. force applied at the middle of the bar when supported in the frame to obtain a three inch deflection, to about ½ to one lb. force applied at the middle of a bar when supported in the frame to obtain a three inch deflection. The stiffness variation can be achieved with different-sized bars, from about ½" to 1⅝" or 2" diameter, for a given bar material, or the stiffness can be achieved using different materials in different bars.

A myriad of low impact or no impact exercises can be performed with the back, the body and the limbs, for therapy to achieve increased range of motion and to lessen or eliminate joint pains as well as to increase strength of specific muscles. Some examples of exercises are described herein.

A very important feature of the invention is that resistance is in a free-flowing natural movement, not hard and restricted to rigid mechanisms such as a rigid lever and pivoting system. The principal reason for this is that the system of the invention employs very flexible bars that produce a soft resistance, as noted above. Additionally, the system includes no fixed fulcrums for the body during exercising. The invention provides a floating resistance mechanism that can slide, rotate and move in many directions.

The system additionally allows a person to exercise in a natural position, i.e., standing upright, sensing one's balance and location in three dimensional space. This has advantages for the handicapped or persons with joint transplants and spine surgical intervention who are not capable of assuming awkward, stressing positions. The machine has easy access, and can actually accommodate a wheelchair moved into the space defined by the frame of the machine.

The system of the invention enables thousands of bar positions and combinations of bar positions to create pivoting, rotating resistance and fulcrums for the body. The bars can be positioned for many different resistance axis fulcrums, to create thousands of different exercises.

The machine of the invention enables therapeutic biomechanical exercises for the treatment of industrial-related injuries. Excellent results have been obtained for rehabilitation of shoulders, for example.

The machine can also be used in combination exercises, such as combining aerobic exercise on the suspended platform and using the vertical bars for exercising arms, shoulders and back. The flexibility and wide range of adjustability of the bars blends conditioning for many sports. As examples, the suspended platform can be used for gait training or running techniques as the practitioner, trainer, therapist or doctor observes the actions of knees and hips as the exercising person jumps up and down or runs in place on the machine.

The machine can also be used for eye and hand coordination, cognitive exercises, and can be helpful for stroke patients.

While a number of different exercise machines and apparatus have had useful aspects, they have been limited in overall benefits one may receive, often limited to specific areas of the body. The invention, however, is flexible and covers such a broad range as to be the equivalent of many prior devices in combination. A range of resistance from very gentle to very firm is provided, to accommodate the weakest and the strongest users, and to provide exercises for arthritic persons. Virtually every part of the human body can be exercised, including the neck, shoulders, upper arms, forearms, hands, back, chest, abdomen, low back, hips, thighs, calves and feet.

A further aspect of the invention is the use of indicia on frame members with numbers to indicate positions, so that exercises can be precisely repeatable. Basically, some of the frame members can include a measuring tape stamped into or otherwise placed onto the metal frame members, or numbers can simply be used to indicate positions.

Covering pads are included, assembled onto the bars when needed. These cylinder foam pads provide padding for fulcrum type exercises wherein the bar is against a portion of the body. Padded bars can also be placed on either side of an exercising user to keep the user from moving off the suspended foot platform during exercising.

Most machines in their movement follow a very rigid, strict and confined range of motion. With the resistance mechanism of the invention the bars are free-floating in space. For example, if one takes a pulley where the cable is attached to a weight and pulls on it, he can move his arm around, but the direction of force is always linear in direction of that cable; whereas when one bends a bar on the invention for resistance, if he pushes down on the bar he has down force; when he lifts up on the same bar there is up force in the opposite direction, as when one pulls or pushes. So, instead of having a single direction of force, one has resistance in a 360° circle. Also, in gripping the bar and hanging on to it, the bar floats in the holes on the end; therefore, the bar can rotate and move in circular motion, making it easy to grasp, making it easier to apply the force without resistance in the grip. With uni-direction of force, the only way one can change the angle of exercising the body is to change the position of the body relative to the direction of force; whereas, with the invention, the user has not only changing the angle of the body, but also the changing force vector. The machine of the invention has additional variations in that while the vector force is in many directions, it also changes the fulcrums in relation to two or more bars. The line of the vector force can be modified in unlimited directions. The main advantage is the flexibility provided in supplying resistance to the body because the human body moves in three dimensional space in almost an infinite number of directions. The system of the invention can accommodate most any motion of the human body.

The platform a person stands on has many advantages over a trampoline, a treadmill or any other gadgets on the market for the following reasons: it is very difficult to balance on a trampoline and very unsafe for older people, people who have had strokes or problems with balance. The system of the invention has a flat rigid platform. That in itself provides stability because it is supported on the flexible rods. For the rods there is a special mounting of polyurethane washers which are suspended by further movement. It allows several inches of 360° motion while also allowing up and down movement. In a sense, the user stands on a firm platform that has spherical motion. When one moves in a vertical up and down motion or jogging or walking, the platform does not only move straight up and down, it moves laterally, forward and backward. In movement, there is compression motion in the joints to further stimulate and rehabilitate cartilage of joints. It is not just simple movement that matters, it is how the pressure is transmitted to the joints and stimulation of the joint receptors, cartilage and ligaments.

Another advantage of the invention over other machines is that one can do balance and cognitive training for people who have dysfunctional cerebellum and vestibular system dysfunction relative to vision, hearing and balance and the coordination of joints.

The machine can be set up with methods of safety. The bars can be put in front and back of the person in such a way that if they lose balance, they have a way to catch themselves. Optionally included is a locking mechanism so the bars cannot come out of the holes on the end.

Accordingly, it is among the objects of the invention to greatly improve the results of exercising, particularly for physiotherapy, to achieve this without significant impact to the exercising person, to accommodate a wide range of exercising persons, to provide for range of motion exercises that have surprising results with users, and to provide an efficient, effective and highly versatile system for achieving these goals. These and other objects, advantages and features of the invention will be apparent from the following description of preferred embodiments, considered with the accompanying drawings.

DESCRIPTION OF PREFERRED EMBODIMENTS

Figure 1:
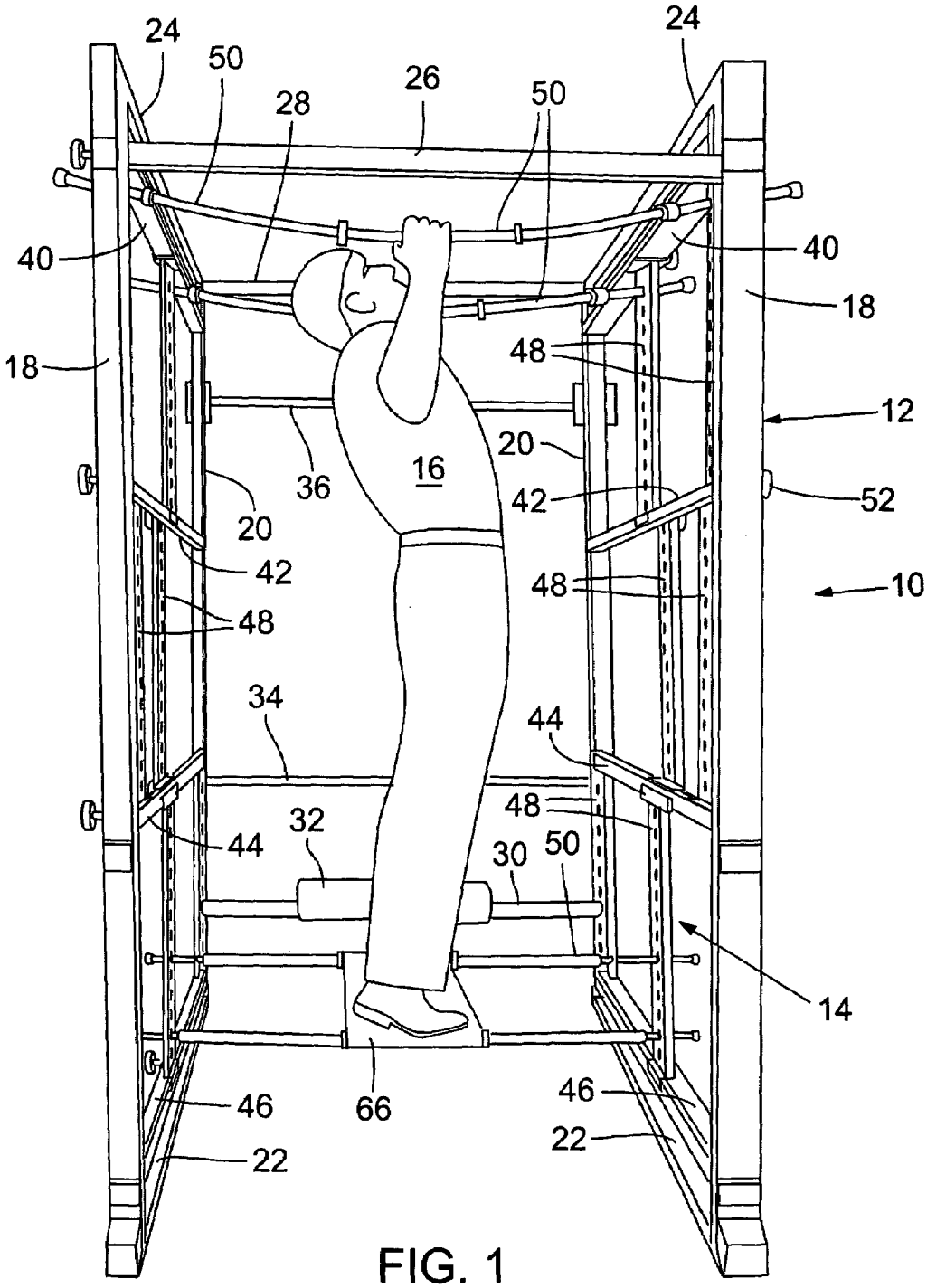
FIG. 1 is a view in perspective showing an exercising machine or system according to the invention, and showing a user doing pull-up exercises on the apparatus.

In the drawings, FIG. 1 shows an exercising and physiotherapy system 10, comprising a machine or apparatus with a frame at 12 made up of a series of frame members and defining a space 14 within which an exercising user 16 positions himself for exercising. The apparatus preferably is at least about six feet in height and at least about four feet in width; it may be at least about seven feet in height.

Figure 2:
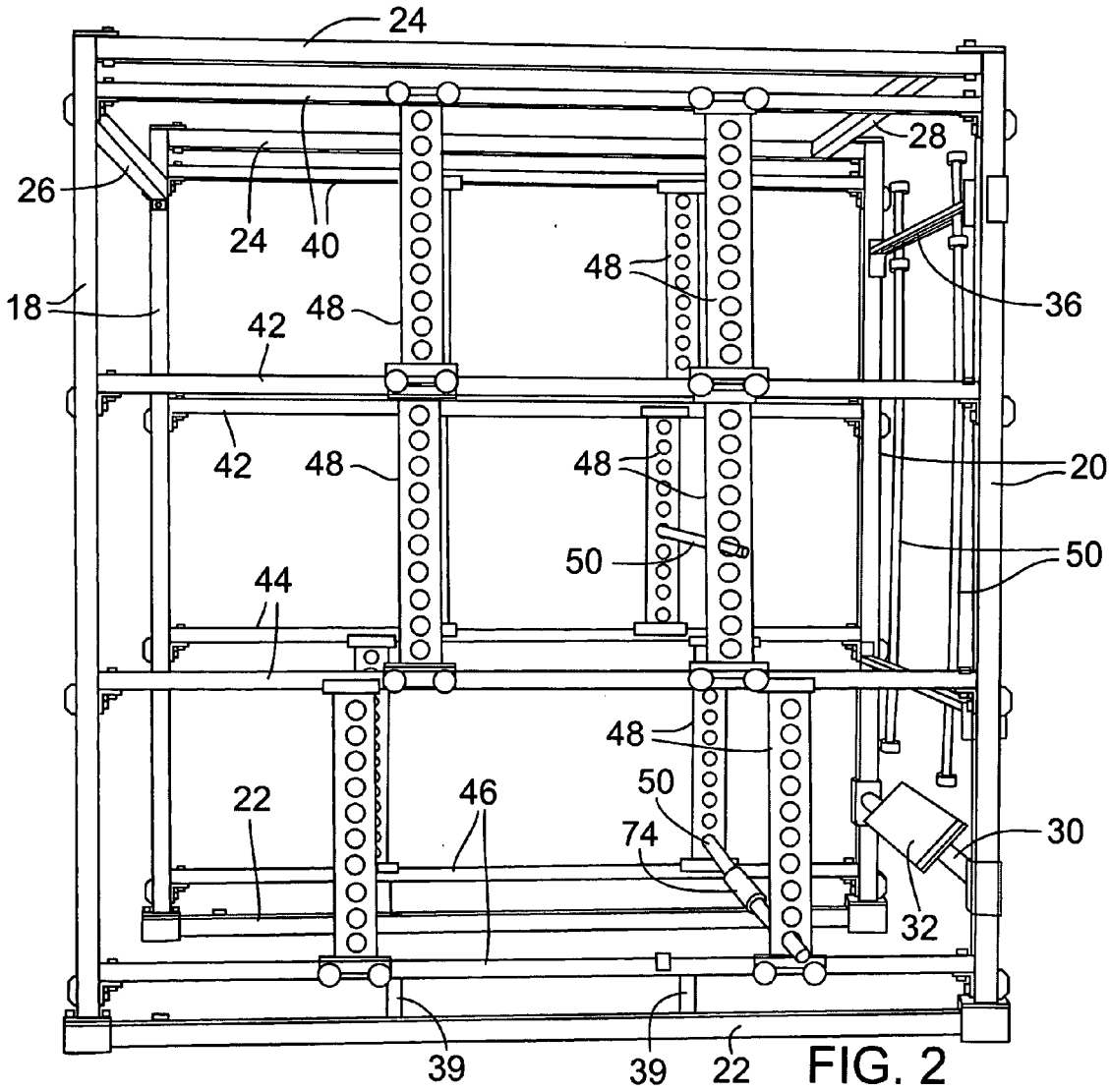
FIG. 2 is a side elevation view in perspective showing the exercising apparatus of the system.
Figure 3:
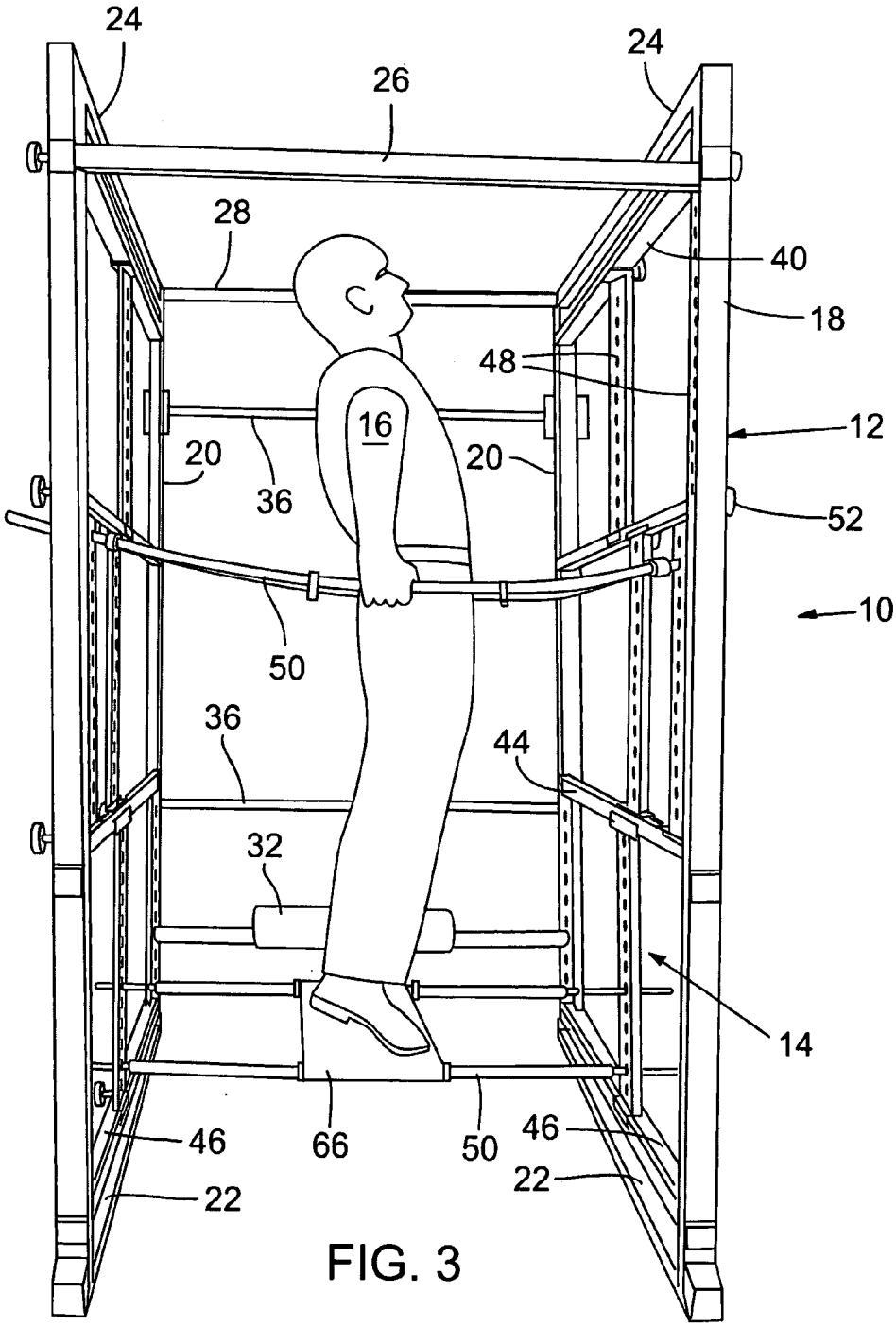
FIG. 3 is an end view in perspective showing the exercising apparatus used to perform dips.

The frame 12, preferably of metal, is comprised of fixed vertical frame members 18 and 20, at opposite ends of the frame, fixed bottom and top horizontal frame members 22 and 24, extending in a longitudinal direction, and fixed transverse frame members including a bar at 26 and a bar at 28, at or near the top of the frame. In a preferred embodiment of the invention, a further fixed transverse member 30 provides a fixed foot platform 32 as discussed above, preferably angled obliquely toward the interior space 14 of the machine as seen in FIGS. 1, 2 and 3, typically at 45°. Further transverse members are shown at 34 and 36, at the end of the machine having the foot platform 32. These horizontal members may be fixed in position or may be semi-permanently attached, repositionable up or down using bolts or other fasteners. As FIG. 2 illustrates, the purpose of these transverse frame members 34 and 36 is to accommodate exercising bars 50 positioned vertically, retained in holes in the members 36 and 38, as further described below.

As also seen in FIGS. 1-3, the frame 12 includes horizontal frame members at different levels on each side of the machine, shown at 40, 42, 44 and 46. These can be permanently fixed to the main frame members 18 and 20, or they can be secured by fasteners such as bolts in a semi-permanent connection or in positions that can be adjusted, if desired. Column type support members 39 preferably are included to support the horizontal frame members 46 on the bottom horizontal frame members 22, to prevent bending under load and enabling the horizontal members 46 to be lighter members.

The horizontal frame members 40, 42, 44 and 46 are positioned and spaced to accommodate adjustably positioned vertical bar support members 48. These vertical members 48 receive flexible bars such as shown at 50 in FIG. 3, as well as in FIGS. 1 and 2, which may include the bars 50 shown vertically positioned in FIG. 2.

The vertical bar support members 48 are an important feature of the invention, providing versatility in positioning of the bars 50 so that, as described above, a nearly limitless number of exercises can be performed on the machine of the invention. In a preferred embodiment at least about twelve of the bar support members 48 are provided. The vertical bar support members 48 are adjustable by horizontal sliding movement along the horizontal frame members 40, 42, 44, 46 between which they are positioned. Their positions may be locked in place using screw fasteners with knobs 52, seen in FIGS. 1-3 and in better detail in FIGS. 16 and 17.

In this preferred embodiment each knob has a machine screw which is threaded through a hole in a bracket 54, preferably U-shaped or channel-shaped as shown, to act as a set screw. The brackets 54 engage the horizontal frame members 40, 42, etc. as a rail, with the channel-shaped bracket 54 slidable over the top edge of the horizontal frame member or rail, or, at the other end of a vertical member 48, along the bottom side of a horizontal frame member or rail, such as 42. FIG. 2, as well as FIGS. 16-19 and FIG. 3A, show that two set screw knobs 52 preferably are included for each vertical bar support member 48. The two set screw knobs 52 provide stability when both are locked into the horizontal rail or frame member, preventing movement of the vertical bar support member 48 even in absence of any set screws at the opposite end of the vertical member. However, as shown in FIG. 2, the vertical members 48 at uppermost positions in the machine may have the knob set screws 52 at both upper and lower ends, because of heavy horizontal loads sometimes placed on these upper members 48 in certain exercises.

Figure 3A:
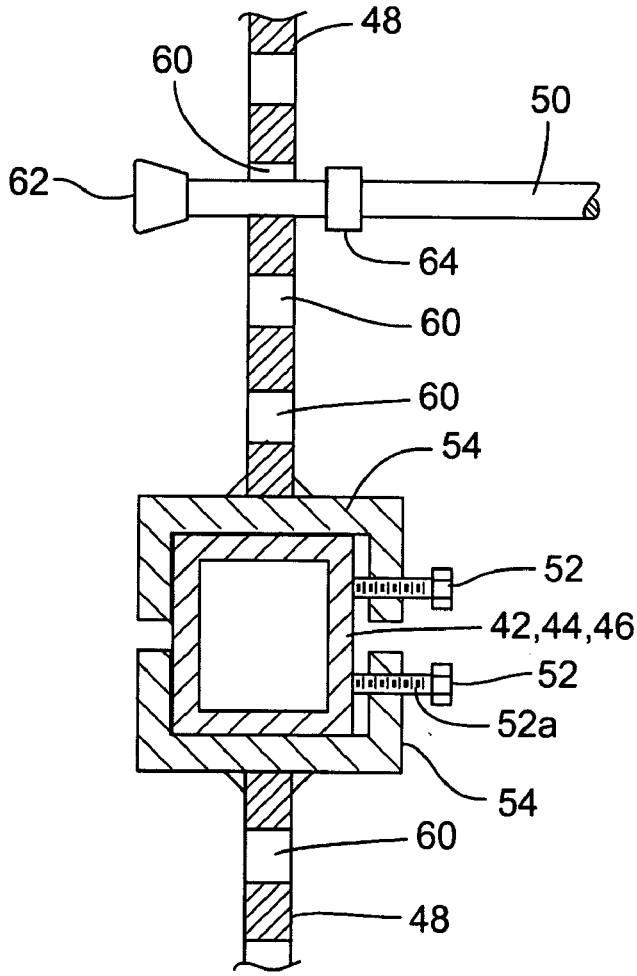
FIG. 3A is a detail view in sectional elevation showing connections between certain members.
Figure 16:
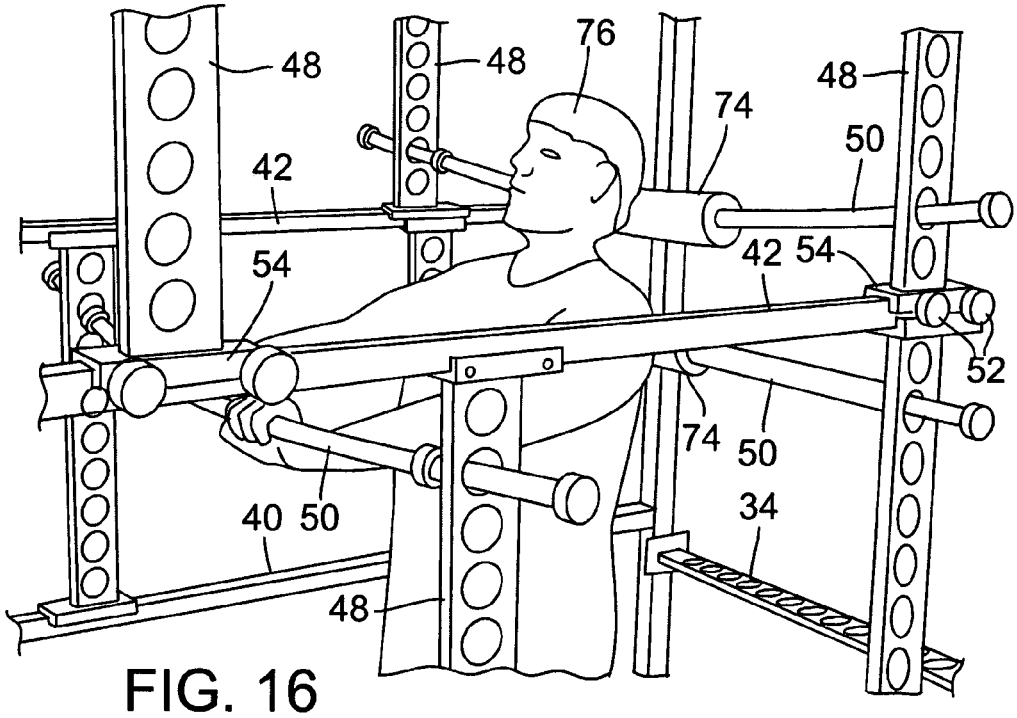
FIGS. 16 and 17 show the apparatus used to provide a three bar fulcrum resistance mechanism to extend the upper thoracic spine and then hyper extend the cervical spine.
Figure 17:
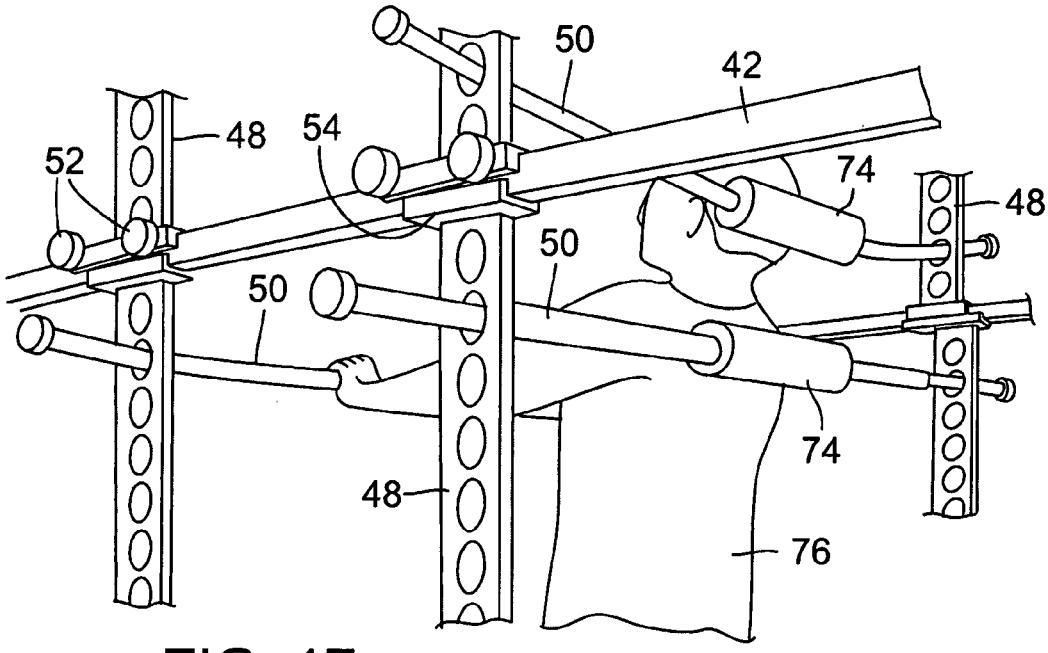

The described retention arrangement for the vertical bar support members 48 has important advantages, both in ease of sliding the vertical members 48 to new positions once the set screw knobs 52 have been loosened, and in accommodating vertical members both above and below a particular horizontal frame member without interference, as can be seen in the FIGS. 16 and 17 and FIG. 3A. The channel-like U-shaped brackets 54 on the ends of the vertical members 48 are shallow enough that vertical members above and below a bar, such as along the bar 42, can slide by one another or be positioned directly in line with one another, as shown in FIGS. 2, 3A and 16-17. In a preferred embodiment, the vertical bar support members 48 are "captured" between horizontal frame members above and below (e.g., 40, 42, 44), and cannot be removed without removing some of the horizontal members 42, 44, etc. The length of the bracket 54 assures this, while also assuring that the vertical numbers 48 remain in a substantially vertical orientation while being adjusted in position, and also assuring that they move smoothly, sliding easily over the horizontal frame member. FIG. 3A shows the bracket 54 in sectional view in greater detail, better showing the channel shape of the brackets 54 and their engagement against the horizontal frame member 42, 44 or 46, and the engagement of the knob/set screws 52 to lock a bracket 54 and the attached vertical bar support 48 in the desired position. In FIG. 3A, two vertical bar support members 48 are shown, one above the other, such as in FIGS. 2 and 16. The knobs 52 are secured to machine screws 52*a* as shown, and in the illustrated configuration, the set screw/knobs 52 of the upper vertical member 48 are locked tight against the horizontal frame member 42, while the bracket 54 on the lower vertical member 48 has its knobs 52 backed off so as to permit correction adjustment. Although knobs/set screws are shown at both the bottom of the upper vertical member 48 and the top of the lower vertical member 48 in FIG. 3A, this is normally not the case, as described above. It is normally sufficient to engage the knobs/set screws at only one end of each vertical number 48.

It should be understood that other forms of quick-engage/quick-release locking of the brackets 54 to the horizontal frame members can be used. For example, an over-center or cam type lock can be secured to the bracket, such that a lever (not shown) is pivoted 180° from an unlocked to a locked position, tightly engaging a cam against the horizontal members (42, 44, 46).

Figure 3B:
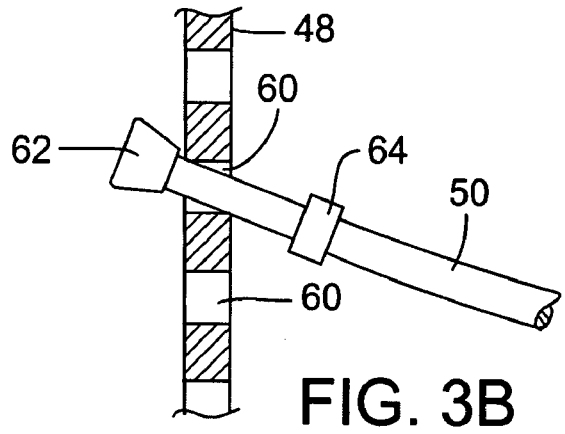
FIG. 3B is another detail view showing some of the subject matter of FIG. 3A.

FIG. 3A, as well as most of the drawings, also shows a series of holes 60 which are preferably closely positioned in each of the vertical bar support members 48 (preferably at least about six holes in each bar support member), to receive flexible exercising bars 50, a portion of one being indicated in FIG. 3A. These bars, which are in a series of different stiffnesses and flexibilities as discussed above, are simply fitted into opposed holes 60 of vertical bar support members 48 positioned approximately equally at opposite sides of the frame 12. As noted above, the horizontal frame members 42, 44, 46 many have a tape measure stamped into the surface, or position numbers on the side of those members, for this purpose. The bar 50, which may or may not have a head 62 at each end, is inserted into the hole 60 at one side, then pulled back to insert the other end of the bar into the vertical bar support member 48 at the other side of the machine. Both the head 62 and an inboard enlarged disk 64 preferably included near each end of each bar are smaller in diameter than the holes 60. When weight or other bearing force of an exercising user is placed against the bar 50, typically near the middle of the bar, the bar flexes as shown in many of the drawings and as shown in FIG. 3B, pulling inwardly in the holes 60 with minimum friction. The enlarged head 62, along with the disk 64 (which has effectively centered the bar), act to contain the bar in place and prevent its pulling out of the bar support member 48. As can be seen from FIG. 3B, the angle of the bar 50 in this deflected configuration, passing through the hole 60, is sufficiently steep that the enlarged head 62, although smaller in diameter than the hole 60, will prevent or discourage the bar from pulling out of the hole. The disks 64 may be spaced sufficiently inward from the heads 62 that they have no actual effect in preventing pullout of the bar, but they act to assist the user in approximately centering the bar between the opposed vertical bar support members 48 on either side of the machine.

The drawings show a few of the very large number of exercises that can be performed using the apparatus 10 of the invention. The exercises are virtually limitless, due to the essentially infinite number of positions the vertical bar support members 48 can be placed, along with the myriad of positions in which the bars 50 can be positioned, supported by the bar support members 48. In addition, the bars themselves are in a wide range of flexibilities, from the stiffest bars wherein a single bar will support the entire weight of an exerciser without a very significant deflection, to the most flexible bars for use by aging exercisers or physiotherapy patients who must, at least initially, exert a minimal amount of force without impact. For example, a range of stiffness/flexibility of a set of bars can be from a stiffest bar requiring about 400 pounds force applied at the middle of the bar when supported in the frame to obtain a three inch deflection at the middle, to a bar of lowest stiffness requiring about 1 pound force applied at the middle of the bar when supported in the frame to obtain a three inch deflection at the middle. This range can vary, and it is preferred that the set of bars include approximately eight to twelve bars or more, preferably with a plurality of bars at each level of stiffness, so as to include pairs of bars of substantially equal stiffness, particularly to provide for exercises such as shown in FIG. 1, where the user 16 has each hand on a different bar 50.

FIG. 1 shows the user 16 doing pull-up exercises on the machine 10. The bars 50 for this exercise are relatively stiff, chosen as desired by the user. Also, the user positions the upright bar support members 48 wherever desired for performing the exercise in the manner intended. Thus, the bar support members 48 which hold the flexible bars 50 are spaced at a distance chosen by the user for comfort and for achieving the most benefit from the exercise as desired. The uppermost holes 60 are used for this exercising user in this case, to perform the pull-ups without having the floor interfere with the exercise. If desired, he can use a suspended platform 66, which is actually displaced laterally from the position of the exerciser 16 in FIG. 1, to initially step up and grab the flexible bars 50.

It can be seen that the exerciser 16 can use a single bar for chin-ups or pull-ups, by turning his body at right angles to the position shown in FIG. 1 and grabbing the single bar either overhand or underhand. All three different types of chin-ups or pull-ups involve different groups of muscles. The user, if of average or above-average weight, will normally select one of the stiffest bars 50 for doing the single-bar exercise. If the bars 50 are lowered to a lower level, then the exercising user can stand on the floor or on the platform 66, to perform a less strenuous exercise wherein the legs assist the person in doing the pull-ups, thus not requiring that the entire body weight be pulled up using the arms.

Figure 21:
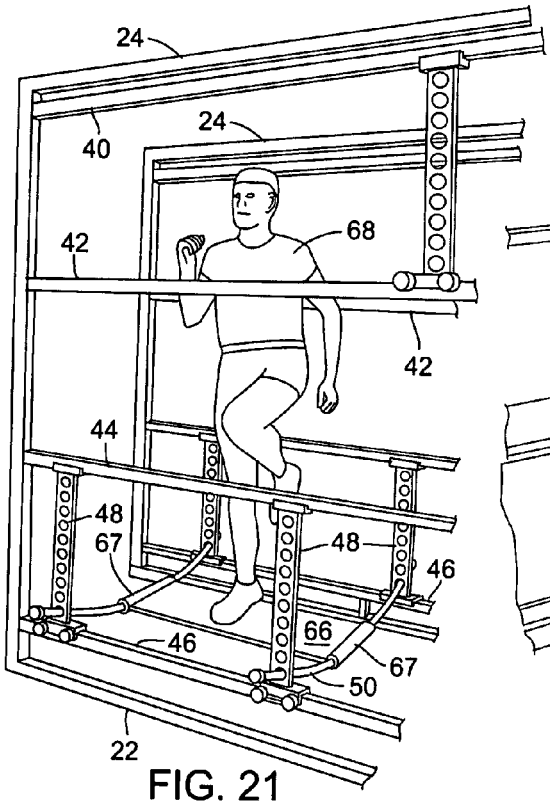
FIG. 21 shows a user running in place using a platform which is suspended in a flexible manner in the frame of the apparatus.

The platform 66 shown suspended near the bottom of the frame 12 is relatively rigid, but is supported by two flexible bars 50 as shown. In FIGS. 1-3, and also in FIG. 21, the platform is shown at a lowermost position with the bars 50 supported in vertical bar support members 48 at the lowest bar receiving holes. The exerciser 16 is not standing on this platform 66 in FIG. 1, but in FIG. 21 an exercising user 68 uses the platform 66, running in place with the platform suspended flexibly by two flexible bars 50. This provides a comfortable, yielding and non-impacting surface for the exercise, thus being easy on joints such as the knees.

In FIG. 3, the exercising user 16 is doing a different exercise using two parallel flexible bars 50, a dip exercise. Again, the user is not standing on the platform 66, but may use that platform to get up into position. Again, the exerciser uses his body weight for the exercise. The bars 50 flex with the person's weight, making the exercise softer and easier on the joints, shoulders, elbows and wrists, as compared to such exercises done on rigid bars.

Figure 4:
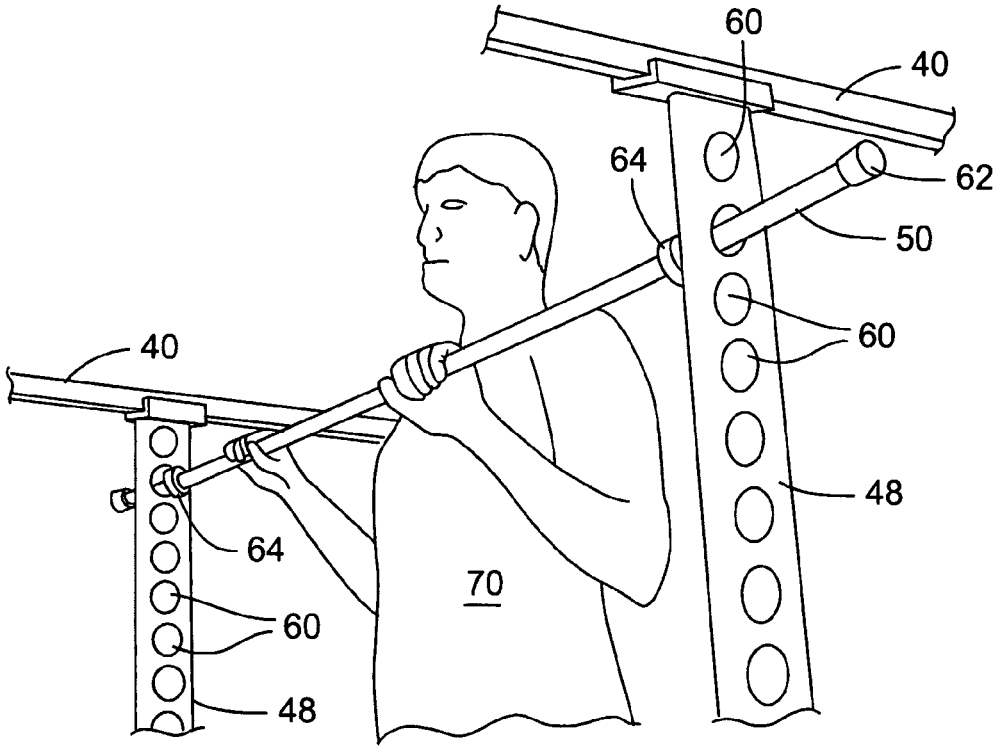
FIGS. 4 and 5 show a user of the machine or apparatus performing a triceps extension exercise.
Figure 5:
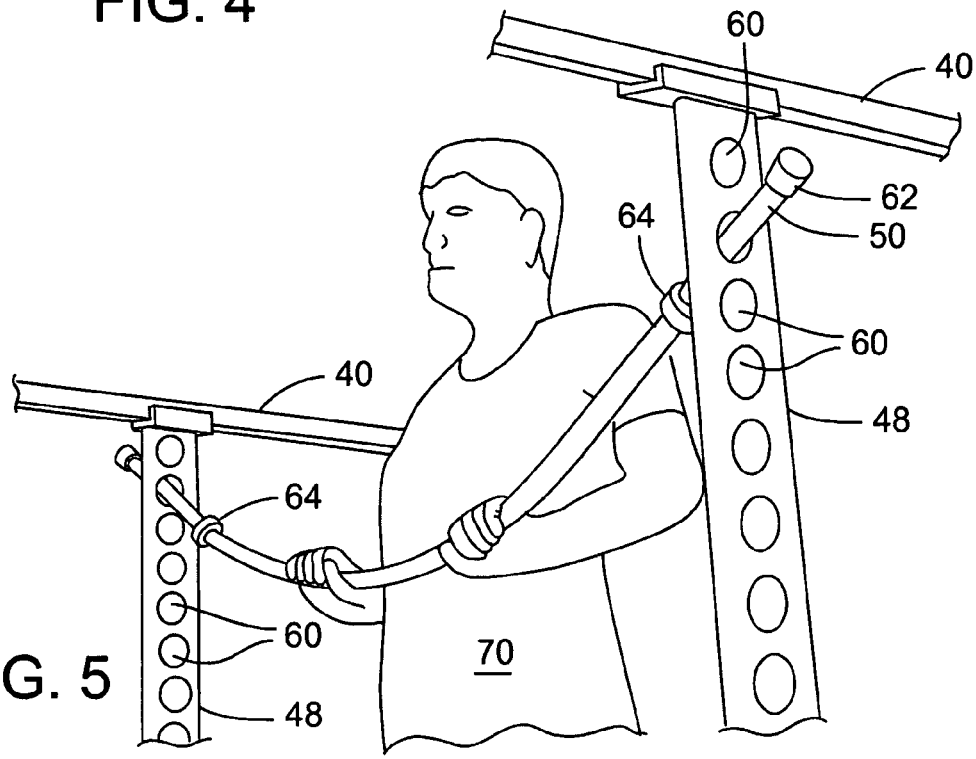
Figure 6:
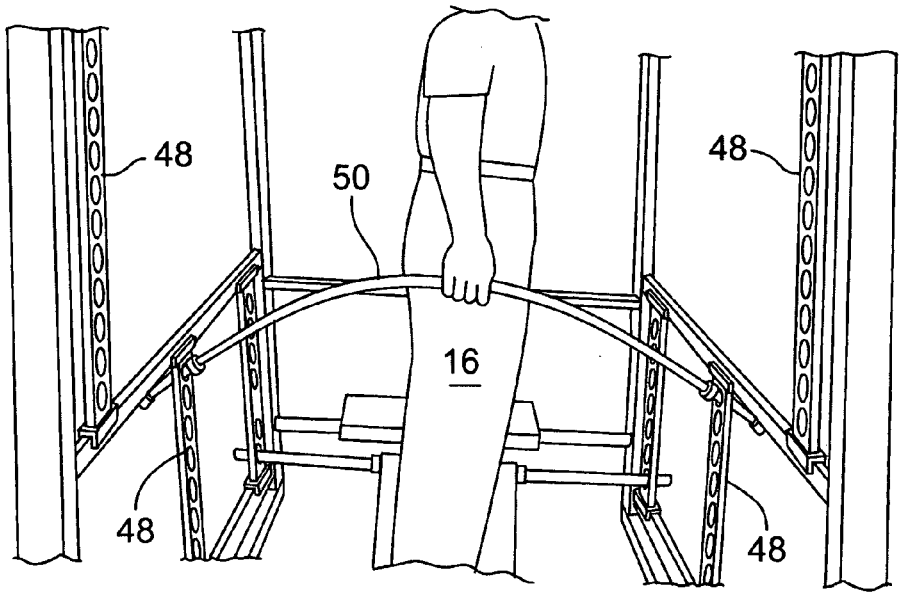
FIGS. 6 and 7 show an exerciser doing a shoulder shrug exercise and a shoulder downward pushing exercise using the apparatus of the invention.

FIGS. 4 and 5 show an exercising user 70 performing a triceps extension exercise. In this case the bar 50 is quite flexible; a stiffer bar can be selected as the exerciser becomes stronger. FIGS. 5 and 6 demonstrate how, particularly in the case of a very flexible bar, both ends of the bar pull inward through the holes 60. The enlarged head 62 at each end of the bar prevents pulling the bar out of the frame, serving as a safety mechanism. The obliquely angled bar ends, relative to the upright bar support members 48, are prevented by the heads 62 from pulling through. In fact, these heads and the angular position of the bar lock the bar so tightly in the vertical bar support members 48 that one's entire body weight would not be capable of pulling the bar out through the holes, even with the most flexible bars.

Figure 7:
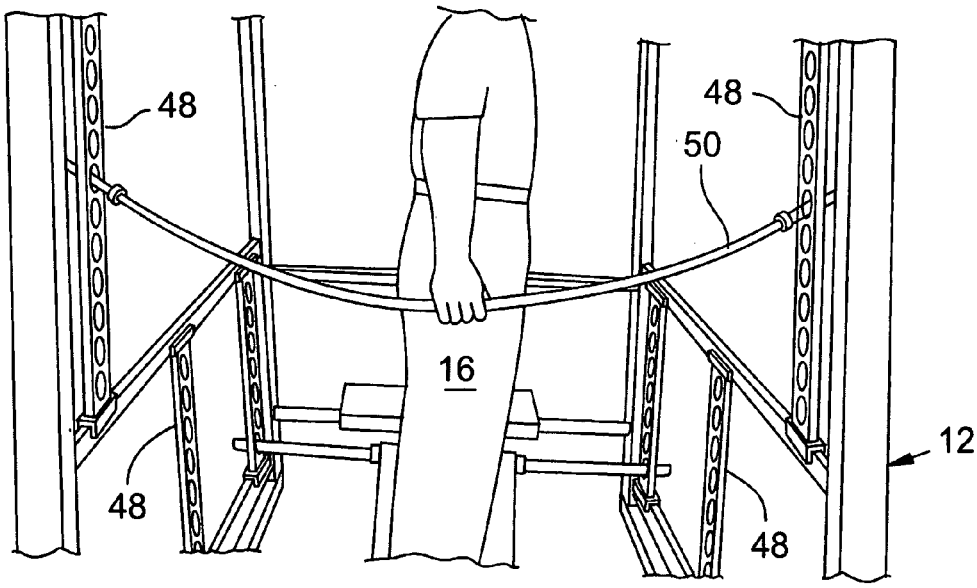

FIGS. 5 and 6 show a shoulder exercise, which can be an effective rehabilitative exercise, enabled by the flexible bars of the invention. Here, the user 16 is exercising using a single bar, i.e. one arm/shoulder at a time, although both arms/shoulders can be exercised simultaneously using two bars. In FIG. 6, the exerciser shrugs the right shoulder upwardly pulling the bar 50 to an upwardly arching configuration as shown. In FIG. 7, the user presses down on the bar, working muscles underneath the shoulder for stabilization. These are good exercises for alleviating shoulder pain which might be caused due to weakness and improper shoulder biomechanics.

Figure 8:
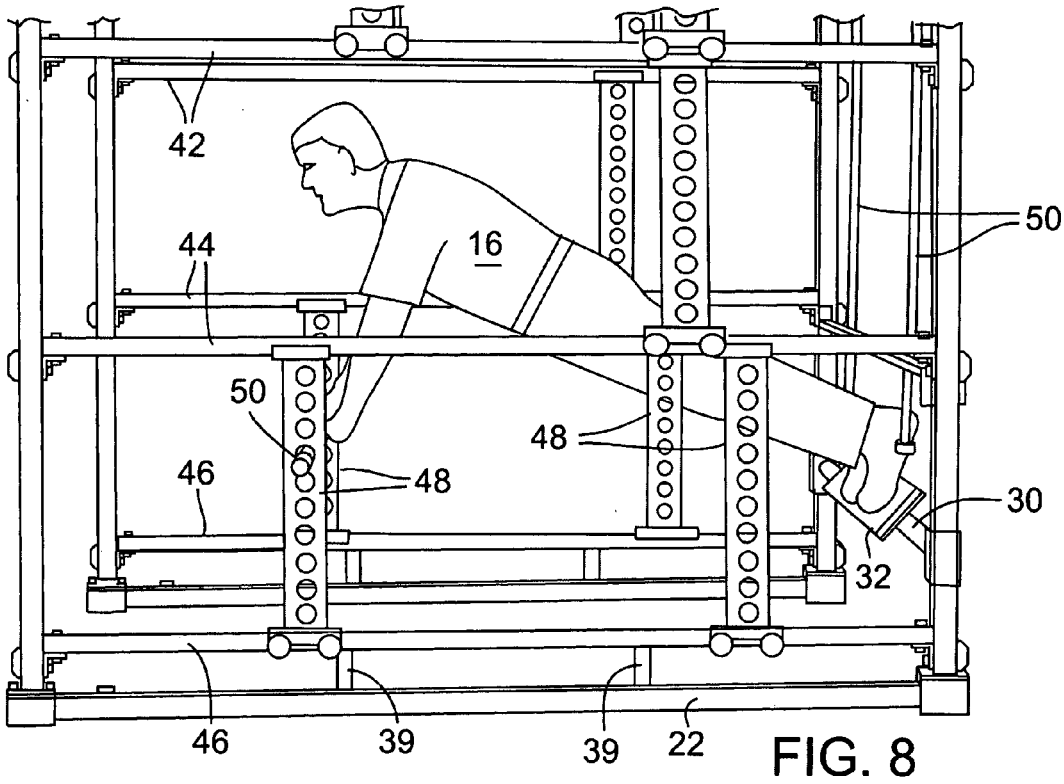
FIG. 8 shows a user doing a modified form of pushups on the apparatus, using an angled, high-friction foot platform at one end of the machine.
Figure 9:
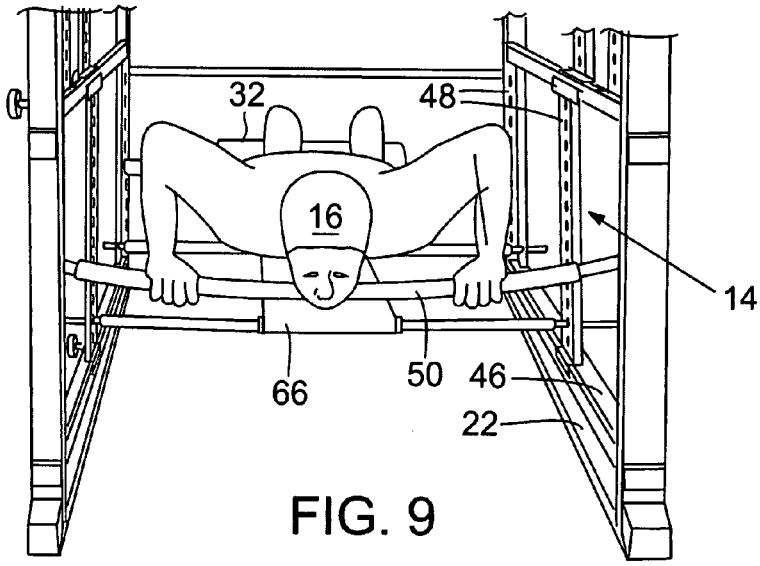
FIG. 9 again shows the modified pushup exercise.

FIGS. 8 and 9 show a user 16 performing a modified form of pushup exercise. In FIG. 8 the user's feet are engaged against the angled platform 32 at the end of the frame, which has a high-friction surface that prevents slippage of the shoes. This is a more advanced form of pushups, with the user's hands gripping a flexible bar 50, as seen in FIG. 9. The bar deflects as shown, making the exercise easier on the joints, without impact. The bar 50 can be adjusted up or down; as the bar is placed higher, the resistance is less, the resistance being from the user's own weight.

Figure 10:
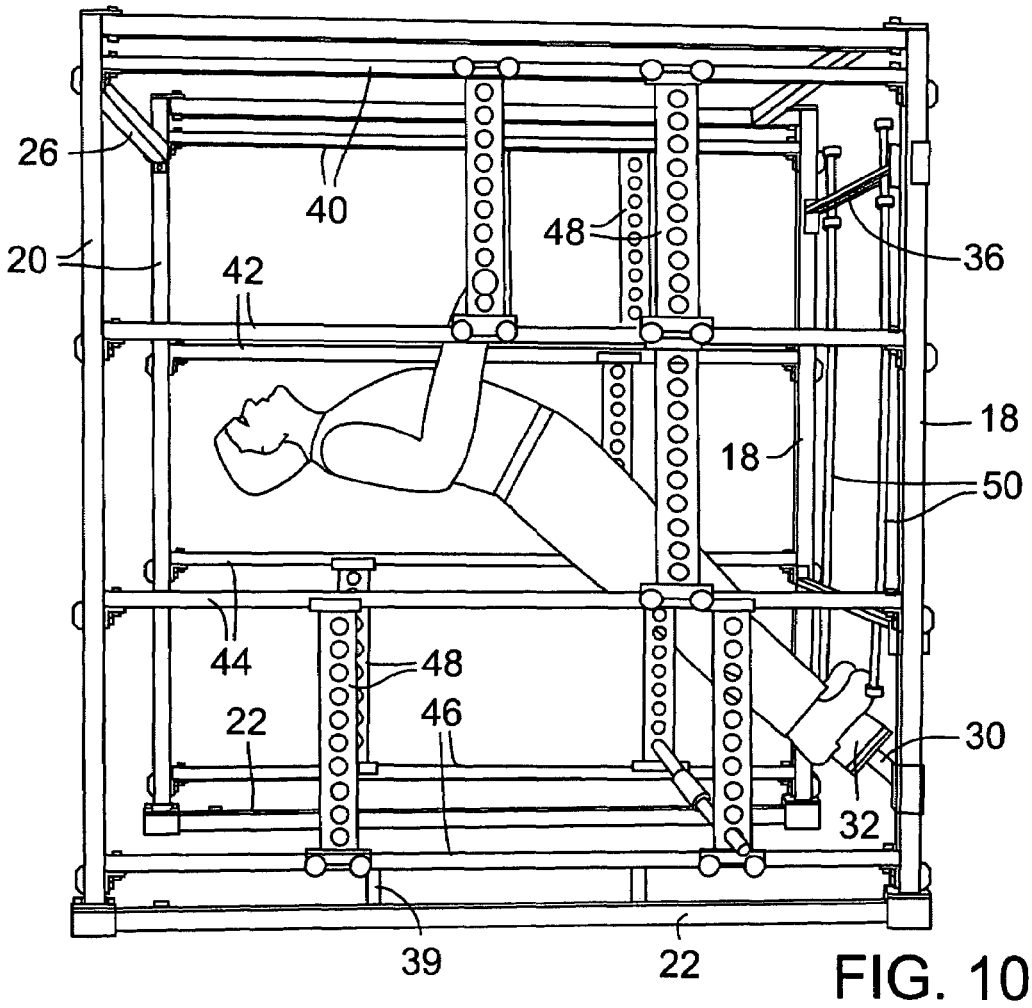
FIG. 10 shows a user of the system performing an advance form of rowing motion exercise.

FIG. 10 shows another exercise using the angled high-friction footplate 32, which may be at an angle of about 45°. The exerciser is inclined in an upwardly facing position in this exercise, which is an advanced form of rowing motions for the back muscles, biceps and forearm muscles gripping the bar. Again, the bar can be adjusted to different heights for more or less resistance. The high-friction plate 32 holds the feet very firmly, no matter the angle of the exercising user.

Figure 11:
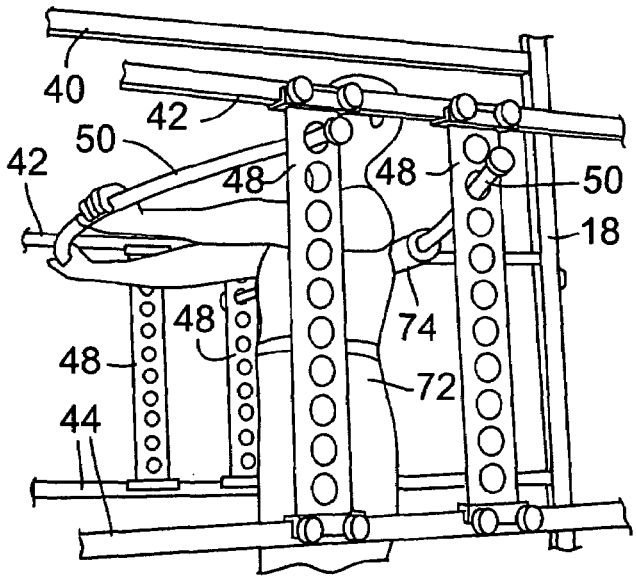
FIG. 11 shows the apparatus of the invention used to perform an exercise that helps improve hyperkyphosis of the upper thoracic spine, using several flexible bars of apparatus.

In FIG. 11, a user 72 exercises between two of the flexible bars 50, one behind and one in front, generally at the shoulder/thoracic level. The drawing demonstrates the upper back, i.e. the upper thoracic spine, leaning against a padded bar 50, the padding being basically a foam sleeve and being shown at 74. The exercising user is pushing out against a front bar 50 and is translating the upper thoracic spine backward, or posteriorly, as an aid to help improve hyperkyphosis of the upper thoracic spine. The rear bar 50 is relatively more stiff and has a sleeve padding 74, while the front bar 50 is relatively more flexible for this exercise. Support is needed behind the back for this exercise, and the flexible bars at both sides remove any joint impact and make the exercising more comfortable.

Figure 12:
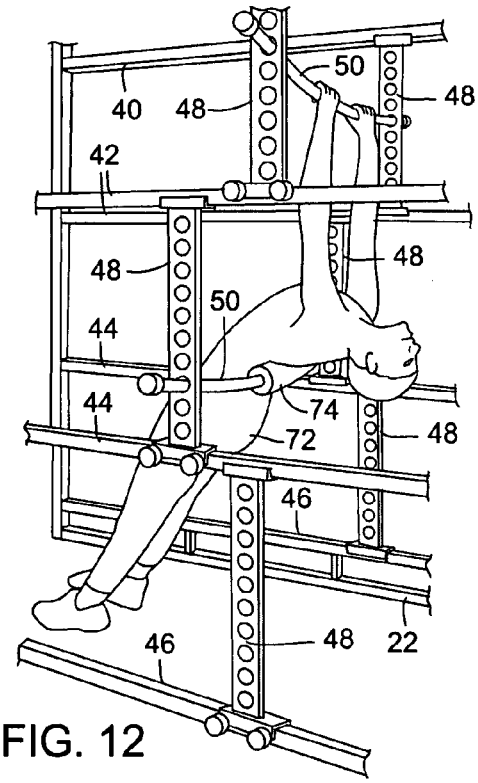
FIGS. 12 and 13 show an exerciser using the machine to perform a range of motion exercise for the lumbar spine and also the thoracic spine.
Figure 13:
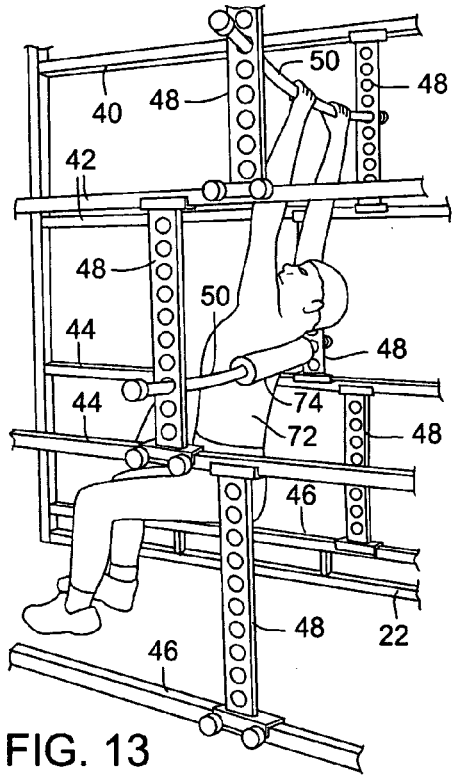

FIGS. 12 and 13 show how an exercising user can do a range of motion, i.e. an extension motion for the lumbar spine and also the thoracic spine. Two of the flexible bars are used: one behind the lumbar spine, preferably padded with a padding sleeve 74, and one up higher and placed back from the lumbar bar as shown. Clearly the heights of the two bars and their relative positions fore/aft can be adjusted as desired. Many people suffer from hyperkyphosis from forward flexion. Working at computers and sitting for hours tend to re-model the spine in an anterior flexion mode. This exercise helps remediate the condition. The pressure on the vertebrae is minimal because one can control how much pressure is on the back, simply by holding more weight with the arms, and when the weight drops down, the exerciser can sink lower, as shown in FIG. 13. As can be seen from these drawing figures, the flexibility of the bar allows the body weight to drop down lower. This extends and puts traction on the upper thoracic spine and extends the cervical spine and at the same time it puts a linear traction in an extended mode on the lumbar spine. Different heights and horizontal positions of the over head bar help determine how much extension one can stretch in this exercise.

Figure 14:
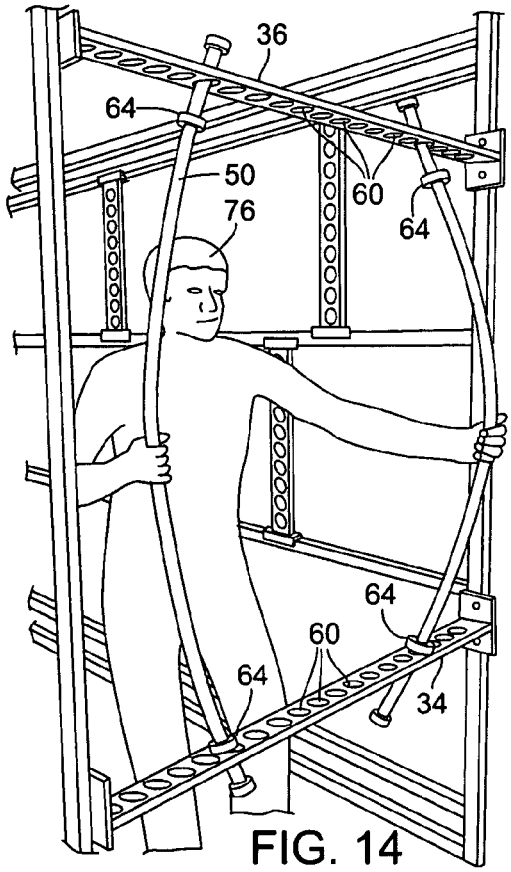
FIGS. 14 and 15 show use of the machine to exercise the arms and shoulders using vertical bars.
Figure 15:
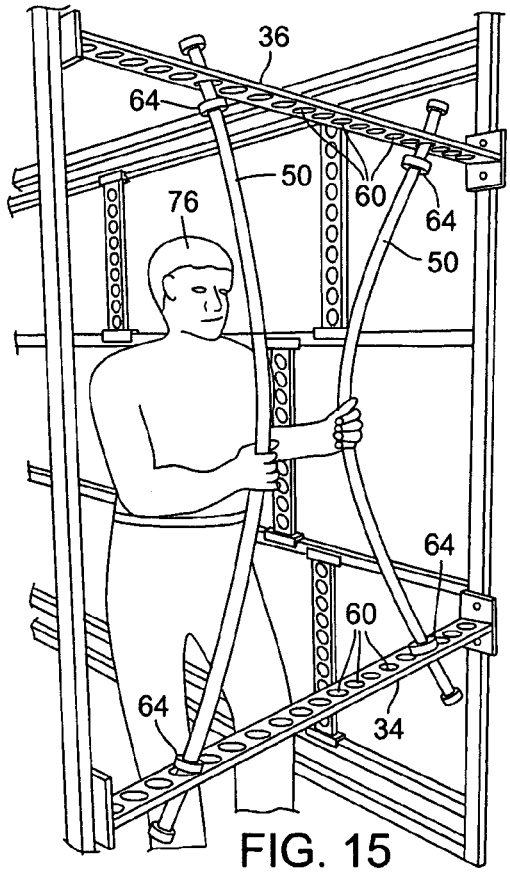

FIGS. 14 and 15 show an exercising user 76 performing an arm and shoulder exercise, with bars 50 in vertical position. For this purpose, the horizontal bar supporting members 34 and 36 are at the end of the machine, as also seen in FIG. 1. Series of holes 60 in each of these horizontal members 34 and 36 retain the two vertically-oriented flexible bars 50 in positions as desired. For this purpose, the inboard fixed discs 64 on the bars, in the position to be near the lower end of the bars, preferably are enlarged so as not to fit through these holes 60. They may also be conical or rounded at their lower sides, so as to smoothly rock back and forth on the holes 60, which also are beveled, making for a non-binding, smoother action.

In the exercise of FIGS. 14-15, the hands can be placed on the vertical bars in various positions. The exercise can be performed at the same time the person 76 is running in place on the flexibly supported platform 66 shown in FIGS. 1 and 3 and also in FIG. 21. This is a very beneficial exercise for stabilization of the shoulders, backs, legs, and also comprises an aerobic type of endurance exercise.

FIGS. 16 and 17 show a three bar fulcrum resistance arrangement for decreasing hyperkyphosis of the upper thoracic spine and then increasing lordosis the cervical spine, an exercise done for hyperlordosis of the cervical curve in extension. This exercise involves three different stiffnesses of bars that allow a combination of two areas of the body to be exercised at the same time. The lightest, most flexible bar 50 is at the back of the head, covered by a sleeve pad 74 and allowing hyper-extension of the cervical spine. The stiffest bar is preferably behind the upper thoracic spine, again with a padding, for a firm but somewhat yielding support of the upper back, as shown in FIGS. 16 and 17. The flexible bar 50 engaged with the user's hands is of an intermediate flexibility, as selected by the particular user, to allow the user to push out and flex the bar 50 with the arms, thus exercising the arm and shoulder muscles, while at the same time providing for extension of the upper thoracic spine and the cervical spine.

In a preferred embodiment the stiffness variation between bars is achieved simply by different-diameter bars, although different materials could also be used.

Figure 18:
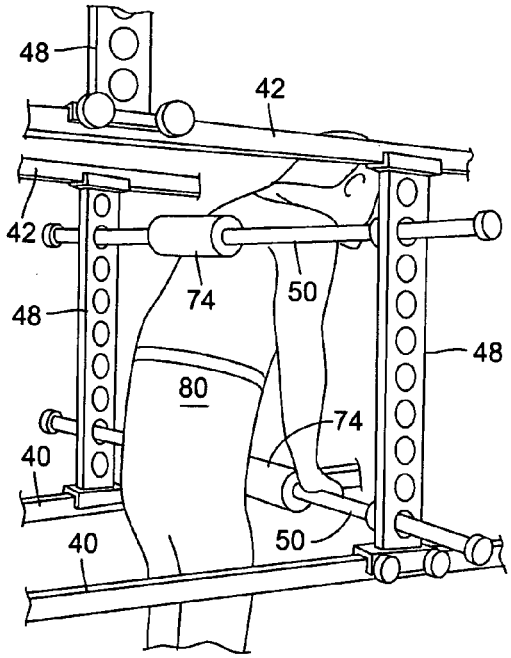
FIGS. 18 and 19 show a user of the apparatus performing a lumbar extension exercise, using two horizontal bars.
Figure 19:
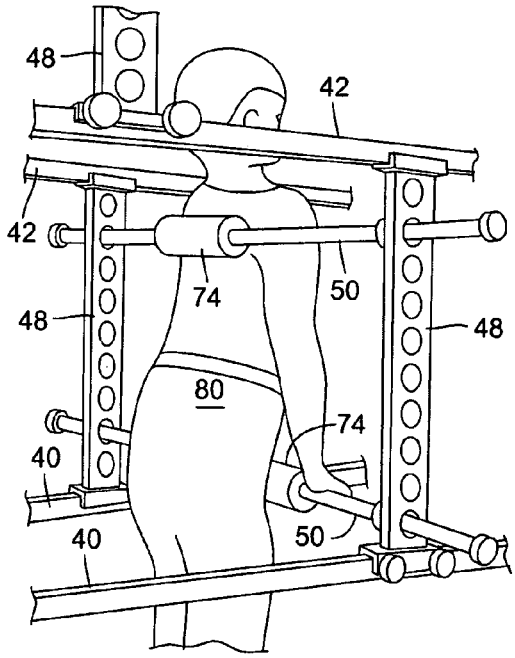

FIGS. 18 and 19 show another type of exercise, in this case using two of the bars 50, both padded, one behind the upper thoracic spine and one generally in front of the groin area and positioned to be gripped with the hands. This is a lumbar extension exercise. The lumbar bar 50, which is relatively stiff, stabilizes the pelvis from going forward as the exerciser 80 moves from the position shown in FIG. 18 to the position shown in FIG. 19, hyper-extending the back to contract the lumbar muscles and also, to some extent, hyper-extending in the thoracic spine region. The upper bar 50 provides a resistance to the exercise, as illustrated, helping to strengthen the muscles as this hyper-extension exercise is performed.

Figure 20:
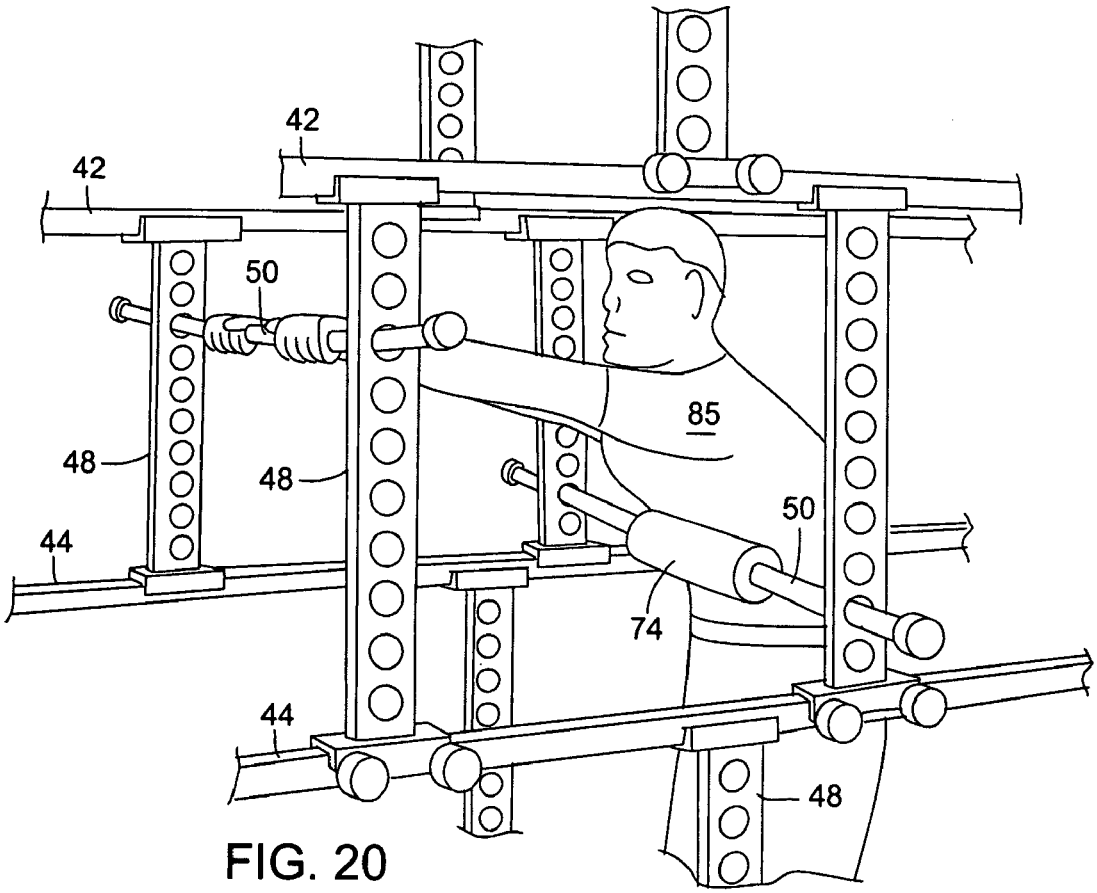
FIG. 20 is a view showing another exercise, for the lumbar muscles.

FIG. 20 shows an exercising user 85 doing an exercise to strengthen the lower lumbar spine muscles, using two bars. One bar 50, padded with a cover pad 74, is positioned in front of the pelvis and is relatively stiff, while the other bar 50 is in front of the person 85, who grips on the relatively flexible bar 50 with the hands and then leans backward, engaged against the padded pelvis bar, further bending the front bar 50 and in doing so, strengthening and stabilizing the lumbar muscles.

As discussed above, FIG. 21 shows a person 68 running in place on a platform 66 which is itself essentially rigid, but which is supported on two flexible bars 50, from upright bar support members 48 which are spaced properly for the platform. The platform 66 has cylindrical sleeves 67 at each end as shown, fitted over the bars 50. In one form of the system, these bars 50 are permanently secured to the platform 66. The platform preferably is wider (front to back) than shown in FIG. 21, and may be about 3' by 3'.

Figure 22:
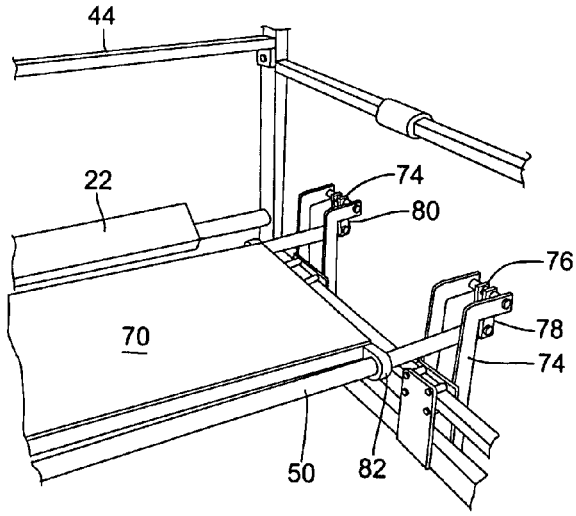
FIG. 22 is a view showing another arrangement for suspending a platform flexibly in the exercising apparatus.

FIG. 22 shows another form of platform and suspension, with several advantages over the platform 66 described above. This platform 70 again is rigid or semi-rigid, but its suspension arrangement allows for translation movement in all directions, i.e. not only in the directions up/down and back/forth as permitted by bending of the supporting bars 50, but also in the left/right directions of movement parallel to the lengths of the bars 50. This is accomplished using suspension frames 74, four of which are provided, two at right (as seen in FIG. 22) and two at left (not shown). Each suspension frame 74 is secured to the bottom horizontal frame member/rail 46 and to the bottom floor-engaging horizontal member 22 of the frame. As is seen in FIG. 22, the suspension frames 74 and the platform 70 are close to the inner end of the machine frame 12, seen near the angled foot platform 32 in FIG. 22. The horizontal movement of the platform 70 is important therapeutically as well as for comfort. When the platform reaches a lowermost position in a running in place exercise, for example, it moves laterally (left/right), as well as fore/aft, and this is beneficial in providing for some rotation of the hip, knee and ankle joints for stimulation of these joints and the supporting tissues. Thus, the exercise is not similar to running in place on a fixed surface but is far better for the user.

The suspension frames 74 suspend an end of a bar 50 as shown, in a gimbal type suspension with a pivot axis 76, a suspending member 78 on the pivot shaft 76, and a pivot connection 80 securing the suspension member 78 to the end of the bar 50. The members 78 should be of a length sufficient to afford the desired motion but not so long as to cause the platform to feel unstable or unwieldy to the user. A length of about 3 inches, or about 3½ to 4½ inches works well for a frame of the dimensions stated herein. As seen in the drawing, the platform 70, which is large enough for running in place with ample room, has four ring connectors 82 which circumscribe the flexible bars 50, holding the platform in place on the two bars 50. This suspension system, with the flexible bars 50, provides for limited movement of the platform 70 in all horizontal directions, while the flexible bars also provide for a resilient, springy suspension of the platform to reduce impact in exercises and to provide a resilient platform on which to stand when performing exercises using bars positioned higher on the machine, when it is desired to lift less than the full weight of the user or to lift up on flexible bars while standing on the flexible platform to exercise the legs and back, a very advanced endurance exercise for sports.

Figure 23:
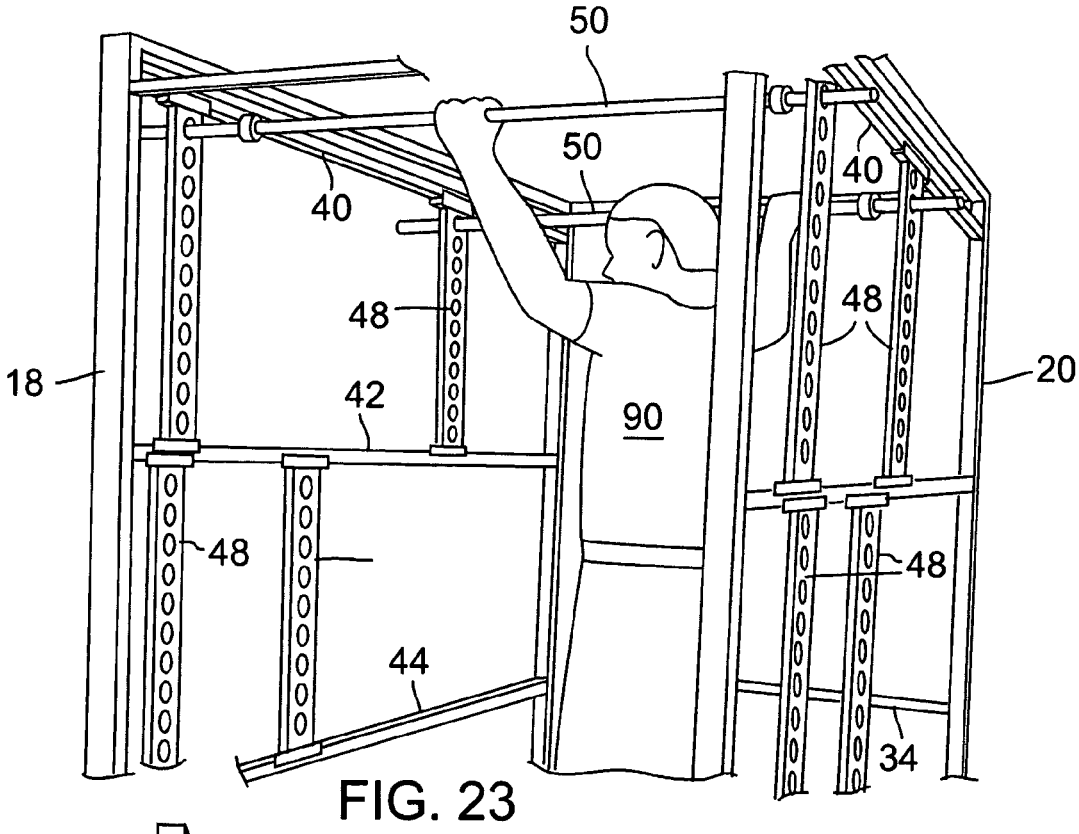
FIGS. 23 and 24 show a further exercise, with bars at two different levels.
Figure 24:
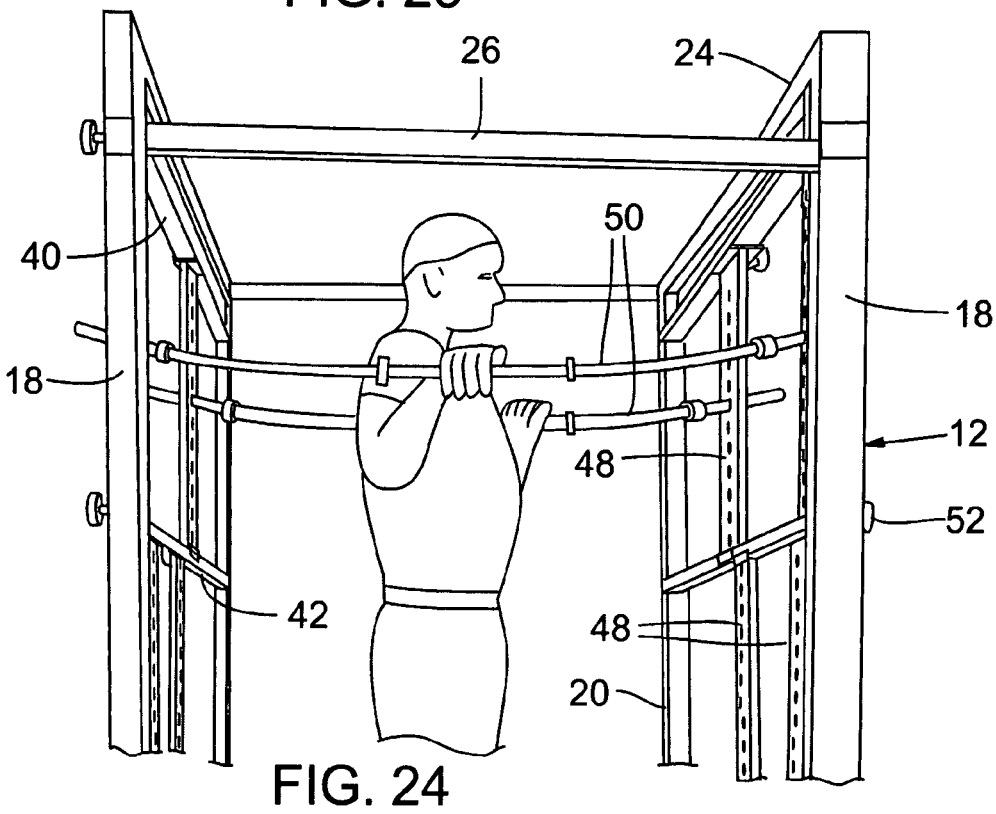

FIGS. 23 and 24 show an exerciser in a pulling exercise using two bars 50 of similar flexibility. The bars are positioned higher in FIG. 23 than in FIG. 24. The exerciser 90 can exert maximum contraction when pulling in on the bars 50 in FIG. 23 with minimum risk of injury to himself, because of the flexibility of the bars generating resistance relative to the user. In FIG. 24 the bars are in a lowered position, so that the exerciser 90 pulls at a different angle with his arms. This exercise involves the grip forearm and also the back muscles. The flexibility of the bars makes the exercise easier on the musculo-skeletal system of the exerciser and makes this an attractive exercise for gradually building up strength, since bars of different flexibilities can be used. This is particularly true for elderly or somewhat incapacitated exercisers.

Other exercises not shown in the drawings include a standing abdominal flexion exercise in which the exerciser stands on the floor or a platform as described earlier, and pulls down on a flexible bar, which can be positioned at various heights approximately at the level of the head or upper body. With the hands gripping the bar with the knuckles upward, the exercise allows a complete range of motion of the abdominal muscles in a hyper-extended position and forward traction. Different stiffnesses of bar can be used for varying amounts of resistance.

In another exercise which is an important physiotherapy machine for an elderly patient or one who has suffered a stroke, the person walks in place or runs in place on the resilient platform as described earlier. At the same time, the patient places a finger successively in different holes 60 of one or several of the vertical bar support members 48, placed adjacent to the person's position. The person counts the holes successively as he runs or walks in place. This exercise teaches cognitive skills in relation to proprioception from the joints and vestibular mechanism, improving eye and hand coordination. After two and one half months, a stroke patient virtually unable to count the holes or extend a finger into the holes while walking in place was able to count up and down the vertical member while running in place on the platform with both hands, without making mistakes.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An exercising and physiotherapy system, comprising:

a frame defining a space within which a user can stand and is positioned for exercising, a collection of flexible bars, essentially straight when unflexed and sufficiently flexible to bend when engaged in exercising movements by a user, including bars in a range of different stiffnesses, the frame having bar support means for receiving and holding the bars, by engaging the bars near both ends of the bars, and for allowing the bars to pull and slide inwardly relative to the frame as the bars are flexed during use, and the bar support means being in a plurality of locations on the frame for selectively positioning one or more bars in a multiplicity of different locations at different selected heights and different selected positions along a length of the frame for a plurality of different exercises for different exercising users.

2. The system of claim 1, wherein the bar support means provides for receiving and holding the bars in both vertical and horizontal bar positions.

3. The system of claim 1, wherein the flexible bars are formed of a hard plastic material.

4. The system of claim 3, wherein the plastic material is acetal.

5. The system of claim 1, wherein the bar support means comprises upright bar support frame members having series of holes into which the two ends of a bar are placed, such that two holes retaining a bar are positioned at corresponding locations at opposite sides of the frame.

6. The system of claim 5, wherein the holes in the bar support frame members have beveled or rounded edges so as to prevent scraping and abrasion of the surface of the bar during use in exercising.

7. The system of claim 6, wherein the bars are formed of a hard plastic material.

8. The system of claim 5, wherein the bars have enlarged heads on their ends, smaller than the holes in the frame members so as to be insertable into the holes but substantially retaining the bar in the frame during exercising use.

9. The system of claim 8, wherein the heads on the bars are only slightly smaller than the holes in the frame members, such that when a bar is in use and flexed under the force of an exercise, the bar will not pull out of the holes due to an obliquely angled position of the end of the bar in the hole, preventing the head from pulling through the hole.

10. The system of claim 8, wherein the collection of flexible bars have varying flexibility, in a range permitting from about 1 pounds force applied at the middle of a bar when supported in the frame to obtain a three inch deflection at the middle, to about 400 pounds force applied at the middle of a bar when supported in the frame to obtain a three inch deflection at the middle.

11. The system of claim 8, wherein at least some of the bars further include an enlarged disc spaced inward of the enlarged head relative to the bar, at least near one end of the bar, the enlarged disc at one end of the bar being larger than said holes so as to block the bar from extending more deeply into a hole than the position of the disc.

12. The system of claim 11, including said discs spaced inwardly from both ends of the bar.

13. The system of claim 11, wherein the bar support means provides for holding the bars in both vertical and horizontal bar positions, the frame including horizontally extending frame members having holes for receiving the bars in vertical position, and the discs supporting the bars from dropping further into the hole beyond the discs.

14. The system of claim 5, wherein the upright bar support frame members extend between horizontal frame members of the frame and are adjustable in position along the length of the horizontal frame members.

15. The system of claim 14, wherein the upright bar support frame members are slidably fitted between the horizontal frame members so as to permit horizontal sliding adjustment, and including releasable fastener means at one end of each moveable vertical elongated member, to lock the elongated member in a selected position.

16. The system of claim 15, wherein the vertical bar support members have slide brackets at top and bottom ends of the vertical bar support members, the brackets being channel-shaped with channels open upwardly at tops of the bar support members and downwardly at bottoms of bar support members, and with the channels engaged over edges of the horizontal frame members so as to permit such horizontal sliding adjustment.

17. The system at claim 16, wherein the releasable fastener means comprises set screws with hand-operable knobs, the set screws being received in threaded holes in the slide brackets so as to engage against the horizontal frame member when tightened.

18. The system of claim 15, wherein the releasable fastener means at one end of each moveable vertical bar support member comprises at least one set screw connected to a knob and rotatable in a threaded hole of the vertical bar support member, to engage against one of said horizontal frame members when the knob and said screw are tightened.

19. The system of claim 5, wherein the upright bar support frame members comprise vertical bar support members having series of holes, the vertical bar support members extend between horizontal frame members of the frame and are adjustable in position along the length of the horizontal frame members, and the horizontal frame members providing at least two different levels in which the vertical bar support members are connected.

20. The system of claim 19, wherein the horizontal frame members provide three levels where the vertical bar support members are connected.

21. The system of claim 5, including at least four of said upright bar support frame members, to enable exercises in which the flexible bars are positioned on each side of a person during exercising.

22. The system of claim 21, including at least about twelve of the upright bar support frame members, each said bar support member having at least about six holes for different bar positions.

23. The system of claim 1, wherein the bar support means provides for holding the bars in both horizontal and vertical positions, the frame including horizontal bar support frame members having holes for receiving ends of the bars between spaced apart pairs of horizontal bar support frame members so as to permit exercising with one or more vertically positioned bars.

24. The system of claim 23, wherein the horizontal bar support frame members with holes are positioned such as to permit exercising the hands and arms with the user in a standing position.

25. The system of claim 1, further including a foot platform for supporting the weight of a user, the foot platform being connected to two of said flexible bars, said two bars being supported near their ends by the frame.

26. The system of claim 1, further including an angled foot platform secured to the frame, near an end of the frame, tilted toward said space defined by the frame, to facilitate certain exercises wherein the user's body is in an oblique or generally horizontal position.

27. The system of claim 1, wherein some of the bars can support the full weight of a user with the bar suspended on the frame between bar support means at opposed ends of the bar.

28. The system of claim 1, wherein the frame is at least about six feet in height and at least about four feet in width as measured between bar support means at opposing sides of the frame.

29. The system of claim 1, wherein the frame is at least about seven feet in height.

30. The system of claim 1, including pairs of flexible bars of substantially equal stiffness.

* * * * *